US009106024B2

(12) United States Patent
Zhao et al.

(10) Patent No.: US 9,106,024 B2
(45) Date of Patent: Aug. 11, 2015

(54) ELECTRICAL CONNECTOR WITH A METAL PLATE FOR PREVENTING ELECTROMAGNETIC INTERFERENCE

(71) Applicant: HON HAI PRECISION INDUSTRY CO., LTD., New Taipei (TW)

(72) Inventors: Jun Zhao, Shenzhen (CN); Jing-Jie Guo, Shenzhen (CN)

(73) Assignee: HON HAI PRECISION INDUSTRY CO., LTD., New Taipei (TW)

( * ) Notice: Subject to any disclaimer, the term of this patent is extended or adjusted under 35 U.S.C. 154(b) by 111 days.

(21) Appl. No.: 14/023,802

(22) Filed: Sep. 11, 2013

(65) Prior Publication Data

US 2014/0073184 A1 Mar. 13, 2014

(30) Foreign Application Priority Data

Sep. 11, 2012 (CN) ..... 2012 2 0460407

(51) Int. Cl.
*H01R 9/03* (2006.01)
*H01R 13/6581* (2011.01)
*H01R 13/6594* (2011.01)

(52) U.S. Cl.
CPC ..... *H01R 13/6581* (2013.01); *H01R 13/6594* (2013.01)

(58) Field of Classification Search
CPC ..... H01R 13/6581; H01R 13/6582; H01R 13/6594
USPC ..... 439/607.55
See application file for complete search history.

(56) References Cited

U.S. PATENT DOCUMENTS

| | | | | |
|---|---|---|---|---|
| 7,422,475 | B2 | 9/2008 | Hirata | |
| 7,682,199 | B2 | 3/2010 | Ahn et al. | |
| 8,215,997 | B2 | 7/2012 | Hsia | |
| 8,550,847 | B2 * | 10/2013 | Hsia | 439/607.11 |
| 8,956,187 | B2 * | 2/2015 | He et al. | 439/607.35 |

FOREIGN PATENT DOCUMENTS

| | | |
|---|---|---|
| CN | 201904481 | 7/2011 |
| CN | 202852044 | 4/2013 |
| TW | M389967 | 10/2010 |
| TW | M435759 | 8/2012 |

* cited by examiner

*Primary Examiner* — Khiem Nguyen
(74) *Attorney, Agent, or Firm* — Ming Chieh Chang; Wei Te Chung

(57) ABSTRACT

An electrical connector (100) includes an insulative housing (1), a number of contact terminals (2), a metal plate (3), and a metallic shell (4) enclosing the insulative housing (1). The terminals and the metal plate (3) are retained in the insulative housing (1). The insulative housing (1) includes a base portion (11) and a tongue portion (12) extending forward from the base portion (11). The contact terminal includes a contacting portion (21), a tail (22), and a connecting portion (23) connecting the contacting portion (21) and the tail (22). The tails (22) are positioned out of the insulative housing (1). The metal plate (3) has a number of positioning end portions (33). The positioning end portions (33) are soldered on a printed circuit board for grounding. The electrical connector (100) has improved electromagnetic interference effect.

9 Claims, 5 Drawing Sheets

ELECTRICAL CONNECTOR WITH A METAL PLATE FOR PREVENTING ELECTROMAGNETIC INTERFERENCE

BACKGROUND OF THE INVENTION

1. Field of the Invention

The present invention relates generally to an electrical connector, and more particularly to an electrical connector a metal plate for reinforcing rigidity of the insulative housing.

2. Description of Related Arts

Universal Serial Bus (USB) interfaces are widely used in various electronic devices. In recent years, a micro USB interface is introduced to meet miniaturization requirement of electronic devices. U.S. Pat. No. 8,215,997 B2 discloses an electrical connector comprising a metallic shell, an insulating housing assembled to the metallic shell, and a plurality of terminals retained in the insulating housing by insert-molding. The insulating housing has a base portion and a tongue portion extending forwardly from the base portion. Each terminal includes a contact portion exposed to a lower surface of the tongue portion, a soldering portion extending out of a back wall of the base portion, and a connecting portion connecting the contact portion and the soldering portion. A metal plate is insert-molded in the insulating housing for reinforcing rigidity of the insulative housing. However, the metal plate is not designed for mounting to a printed circuit board such that the metal plate does not shield EMI.

U.S. Pat. No. 7,682,199 B2 discloses a plurality of contacts and a housing holding the contacts. The housing comprises a body portion, and a flat plate-shaped fitting portion projecting from the body portion. The fitting portion comprises a first main surface and a second main surface opposite to each other and a pair of side surfaces connecting between the first main surface and the second main surface. A metal cover portion is integrally formed with the housing by insert-molding and extends along a periphery of the fitting portion to cover the second main surface and the pair of side surfaces for reinforcing rigidity of the fitting portion of the housing. However, the metal plate also is not designed to be mounted to a printed circuit board such that the metal plate does not shield EMI.

An electrical connector that can be securely fixed to a printed circuit board and preventing EMI is desired.

SUMMARY OF THE INVENTION

Accordingly, an object of the present invention is to provide an electrical connector securely fixed to a printed circuit board and preventing EMI (electromagnetic interference).

To achieve the above object, an electrical connector includes an insulative housing, a plurality of contact terminals, a metal plate, and a metallic shell enclosing the insulative housing. The contacts and the metal plate are retained in the insulative housing. The insulative housing includes a base portion and a tongue portion extending forward from the base portion. The contact includes a contacting portion, a tail, and a connecting portion connecting the contacting portion and the tail. The tails are positioned out of the insulative housing. The metal plate has one or more positioning end portions. The positioning end portions are soldered on a printed circuit board for grounding. The electrical connector has improved EMI effect.

Other objects, advantages and novel features of the invention will become more apparent from the following detailed description when taken in conjunction with the accompanying drawings.

DETAILED DESCRIPTION OF THE PREFERRED EMBODIMENT

Figure 1:
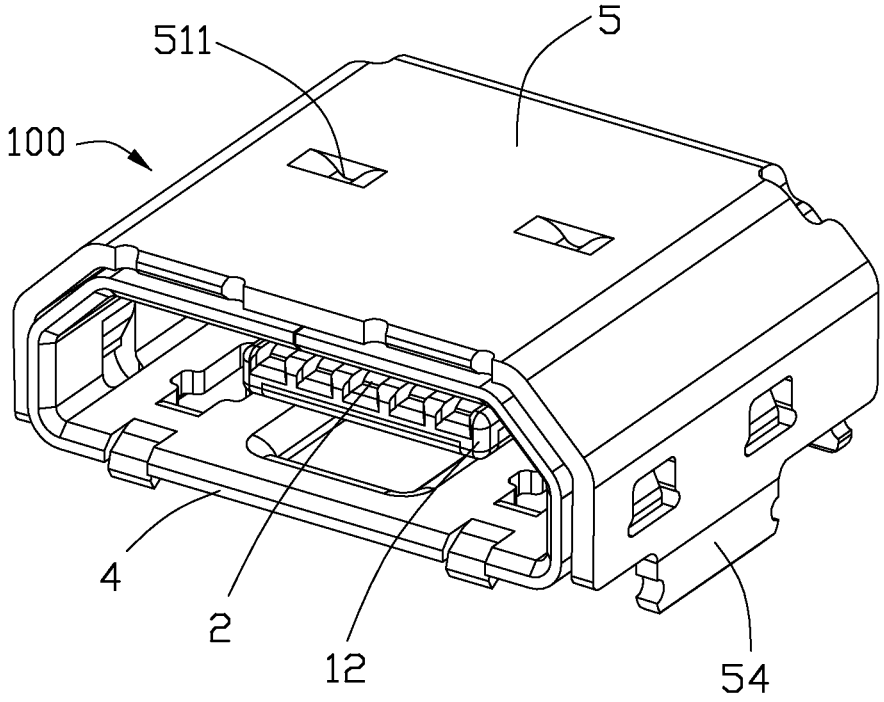
FIG. 1 is an assembled, perspective view of an electrical connector according to a preferred embodiment of the present invention.
Figure 2:
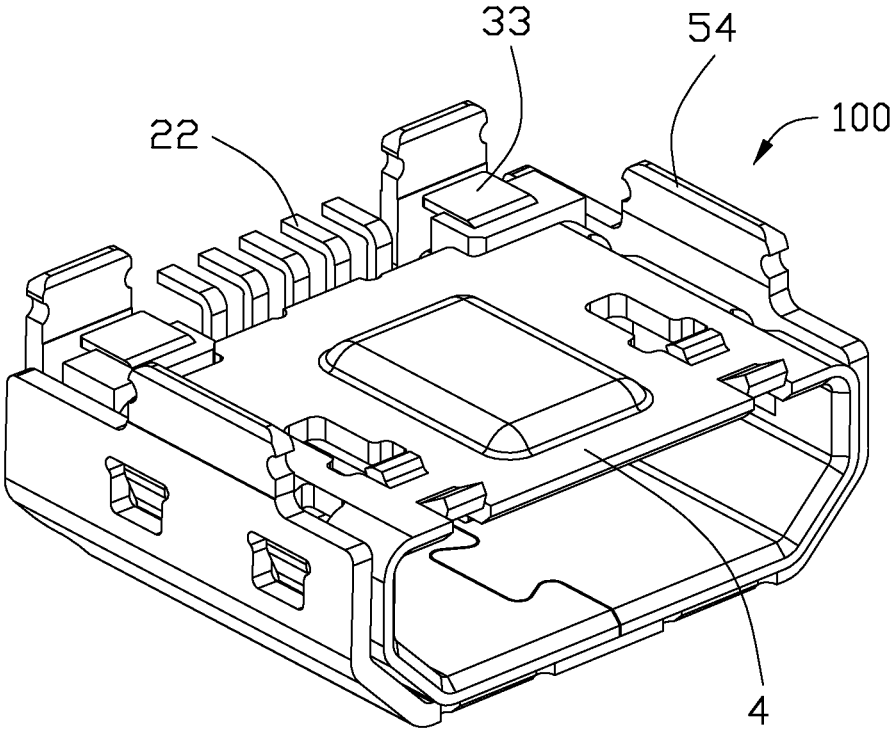
FIG. 2 is a view similar to FIG. 1 but from a different perspective.

Reference will now be made in detail to the preferred embodiment of the present invention.

Referring to FIGS. 1 to 5, an electrical connector 100 includes an insulative housing 1 with a number of contact terminals 2 held therein, a metallic shell 4 defines a receiving room 44 and combined to the insulative housing 1, a sub-shell 5 covering the metallic shell 4 and a metal plate 3 retained in the insulating housing 1 for reinforcing rigidity of the insulative housing. According to the illustrated embodiment of the present invention, the electrical connector 100 is regarded as a micro USB (Universal Serial Bus) interface.

Figure 3:
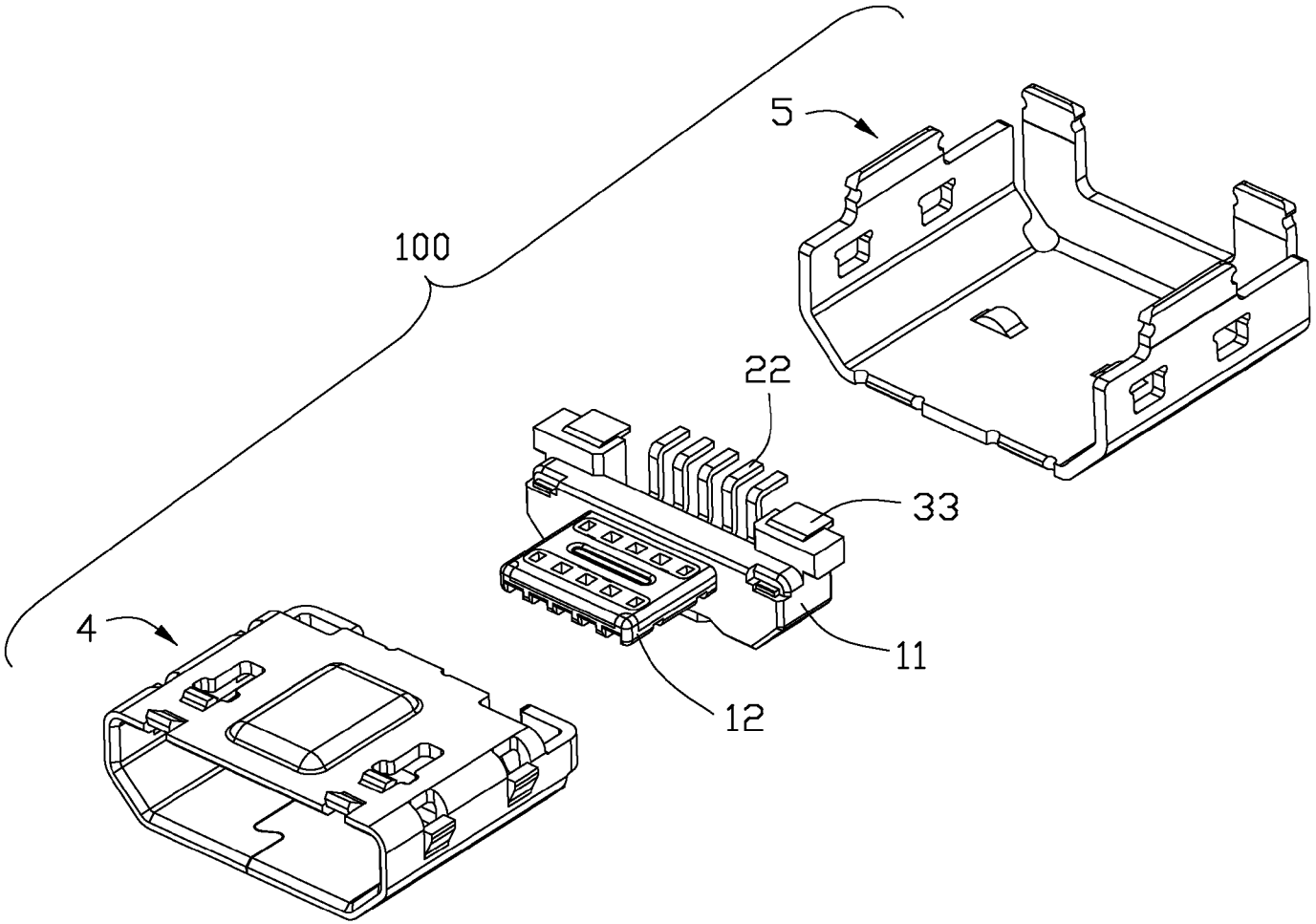
FIG. 3 is a partly-exploded, perspective view of the electrical connector of FIG. 2, showing a metallic shell and a sub-shell separated from an insulative body of the connector.
Figure 4:
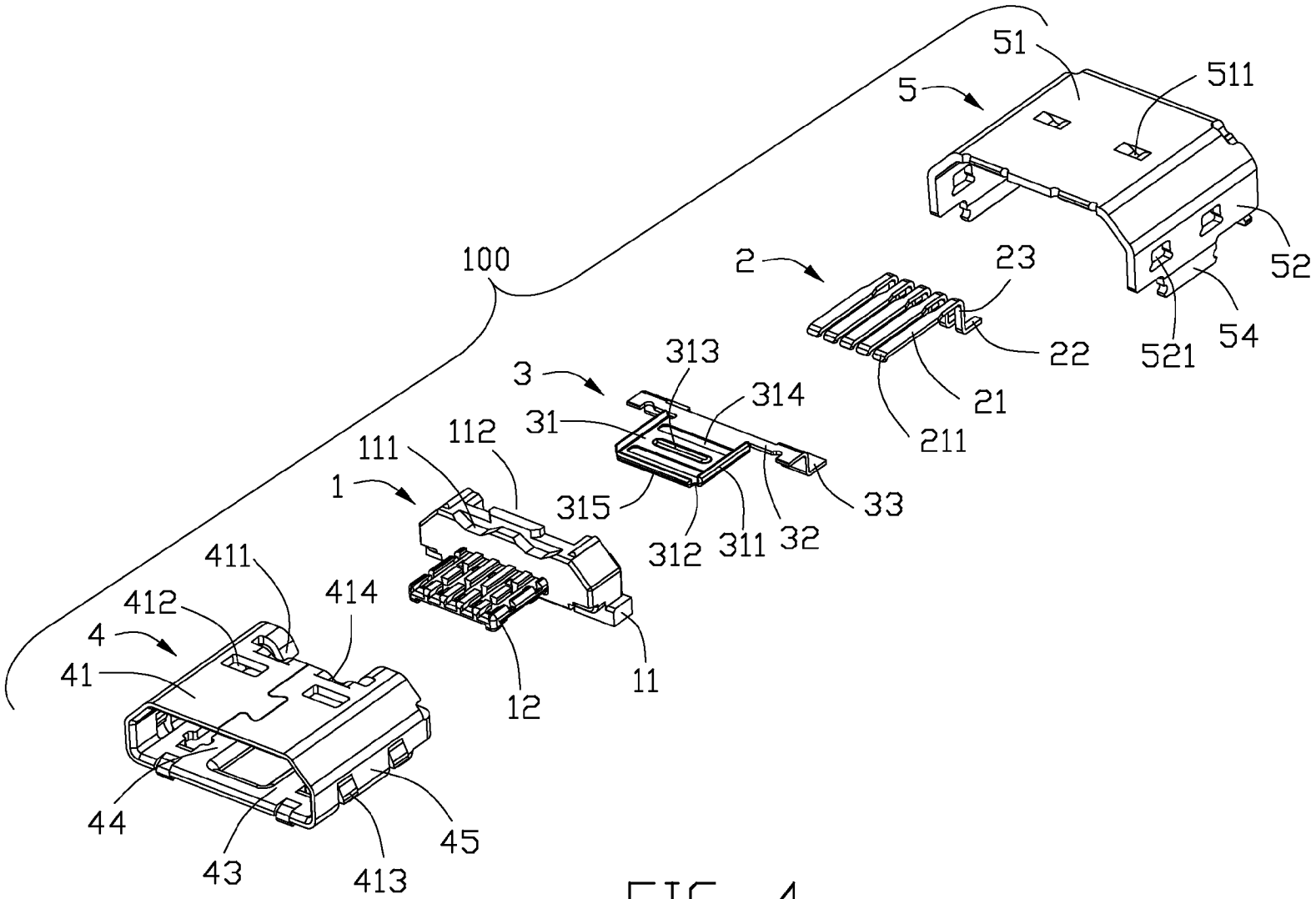
FIG. 4 is an exploded, perspective view of the electrical connector of FIG. 1.
Figure 5:
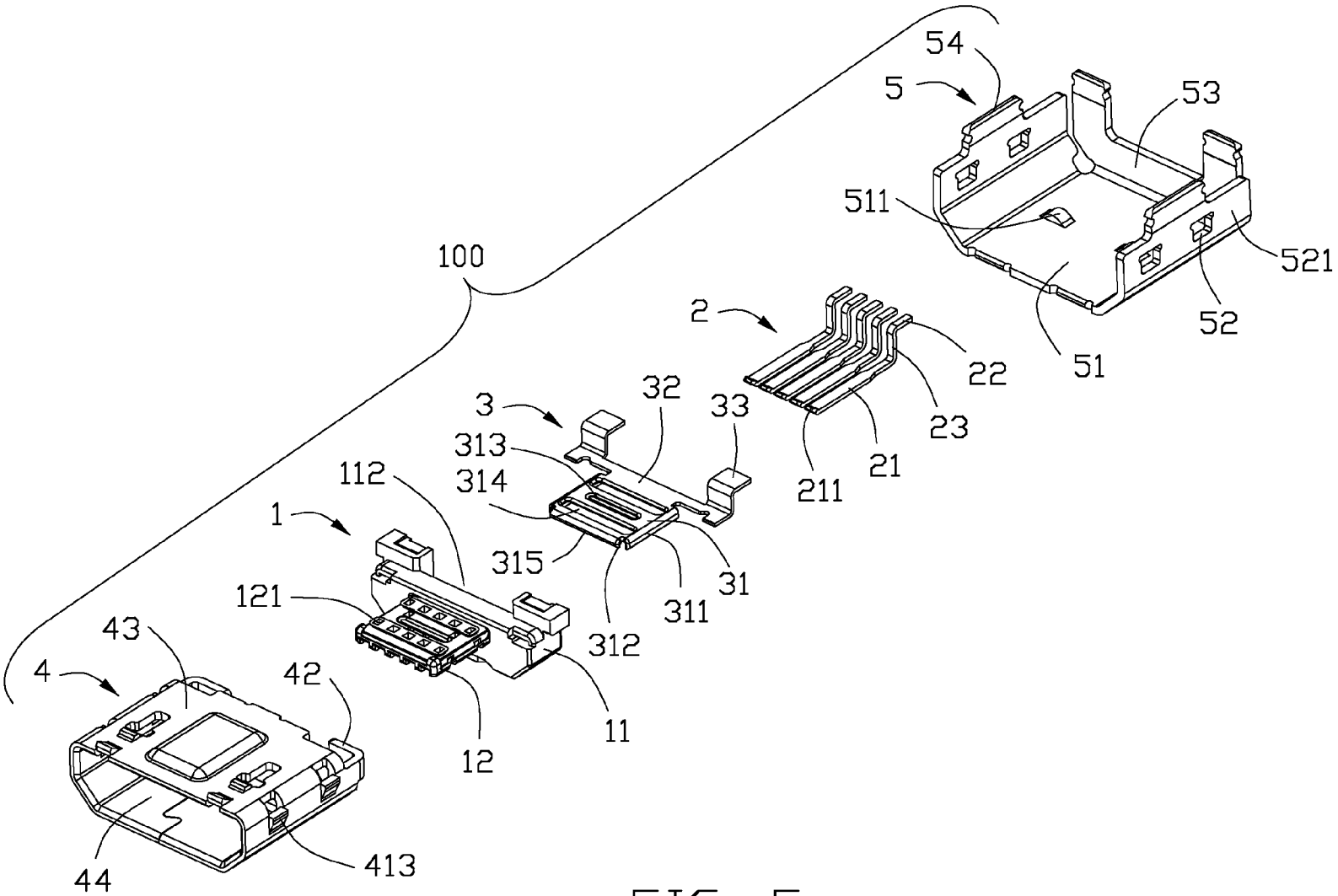
FIG. 5 is an exploded, perspective view of the electrical connector of FIG. 1.

Referring to FIGS. 3 to 5, the insulating housing 1 comprises a base portion 11 and a tongue portion 12 extending forwardly from the base portion 11 and forwardly into the receiving room 14 of the metallic shell 4. A upper surface of the base portion 11 defines a pair of notches 111 through a front surface of the base portion 11 and a slot 112 through a rear surface of the base portion 11, the pair of notches 111 and the slot 112 are spaced apart from each other by a insulative protrusion (now show) located therebetween. The tongue portion 12 defines a plurality of location holes 121 for inserting location molds (now show), said terminals 2 and said metal plate 3 retained with each other by insert-molding and fixed by the location molds inserting in the location holes 121.

Referring to FIGS. 3 to 5, the contact terminals 2, made of metal material, which are compatible to version 2.0 Micro Universal Serial Bus. That is to say, the definition of the contact terminals 2 for signal transmission is compatible to version 2.0 Micro Universal Serial Bus. Each contact terminal 2 includes a flat contact portion 21 exposed upon of the tongue portion 12 for connecting with a mating connector, a tail 22 extending out of a back wall of the base portion 11 for soldering with the printed circuit board, and a 7-shaped connecting portion 23 connecting the flat contact portion 21 and the tail 22. The front end of the flat contact portion 21 defines an arc-shaped guiding portion 211 for guiding the mating connector insertion, the arc-shaped guiding portion 211 also used to prevent the contact portion 21 from spring. The contact portion 21 is wider than said tail 22, and a spacing between any two of the contact portion 21 is narrower than it between any two of the tail 22. The tails 22 solder with the printed circuit board easily with bigger spacing between thereof.

Referring to FIGS. 3 to 5, metal plate 3 retained on a lower surface of the tongue portion 12 by insert-molding for reinforcing rigidity of the tongue portion 12, comprises a plan main portion 31, a pair of curved portions 32 extending rearwardly and then oppositely, laterally from the main portion 31, and a pair of positioning end portions 33 formed at two distal ends of the curved portions 32. Each positioning end portion 33 extending rearwardly and than bending from the end of curved portion 32. The positioning end portion 33 is wider than the contact portion 21.

Referring to FIG. 4, the plan main portion 31 covers the lower surface of the tongue portion 12, defines a pair of side parts 311 extending from two sides thereof, a front part 315 extending from a front end of the plan main portion 31 and a rib 313 Located at a upper surface thereof. The rib 313 extends perpendicular to the side parts 311. The pair of side parts 311 and the front part 315 are used to partly cover the two side surfaces and fount surface of the tongue portion 12. A gap 312 formed between each side part 311 and said front part 315. The gap 312 and the rib 313 are used to hold the metal plate 3 and the tongue portion 12 reliably. The plan main portion 31 has a pair of through holes 314 extending through thereof and extending along the transversal direction for inserting said location molds. Said rib 313 located at the middle of said two through holes 314 along front-to-back direction. Said rib 313 has a length smaller than that of the though hole 314. The curved portion 32 retained in the base portion 11 of the insulating housing 1. According to the illustrated embodiment of the present invention, the positioning end portions 33 extending out of the rear wall of the base portion 11 and soldered on the printed circuit board for preventing EMI (electromagnetic interference) effect. The positioning end portions 33 are substantially coplanared with the tail 22 of the contact terminal 2 for being easily soldered on the printed circuit board.

Referring to FIGS. 2 to 5, the metallic shell 4 covering the insulative housing 1 comprises a top wall 41, a bottom wall 43 and two side walls 45 connecting with the top wall 41 and the bottom wall 43 for cooperatively defining said receiving room 44 in which a mating connector (not shown) is inserted along a front-to-back direction. Each side wall 45 has a locking strip 42 inwardly bent from a rear end thereof for resisting against a rear surface of the insulative body 1. The top wall 41 has a pair of protrusions 414 extending inside from a end thereof, and a pair of projections 411 extending inside behind the protrusions 414. The protrusions 414 abutting against the notches 111 and the projections 411 abutting against the slot 112 so as to restrict a movement of the metallic shell 4 with respect to the insulative body 1 along a front-to-back direction. The top wall 41 has a pair of slots 412 extending through from thereof and located at the front of the projections 411 along a front-to-back direction. Each side wall 45 defines a pair of spring tabs 413 extending outwardly from thereof.

Referring to FIGS. 2 to 5, the sub-shell 5 is made by metallic material, includes a horizontal pressing plate 51 for covering on the top wall 41 of the metallic shell 4, two extending plates 52 extending downwardly from two opposite sides of the pressing plate 51 for resisting on the side walls 45 and a n-shaped vertical tab 53 extending downwardly from the rear edge of the pressing plate 51 for resisting against the locking strip 42 of the metallic shell 4. Each extending plate 52 has a pair of inter space 521 extending through from extending plate 52 for spring tabs 413 of the metallic shell 4 to be engaged therewith. The top wall 51 forms a pair of locking pieces 511 extending downwardly from a rear part thereof. The locking pieces 511 are received in the slots 412 of the metallic shell 4 for securing the metallic shell 4 and the sub-shell 5. Each extending plate 52 and vertical tab 53 includes at least one solder part 54 to be assembled on the printed circuit board for grounding and preventing EMI effect.

The electrical connector 100 of the present invention comprises the metal plate 3, the metal plate 3 includes at least one positioning end portion 33, the positioning end portions 33 are soldered on the printed circuit board for having improved EMI effect. The positioning end portions 33 are substantially coplanared with the tail 22 of the contact terminal 2 for being easily soldered on the printed circuit board.

While a preferred embodiment in accordance with the present invention has been shown and described, equivalent modifications and changes known to persons skilled in the art according to the spirit of the present invention are considered within the scope of the present invention as described in the appended claims.

What is claimed is:

1. An electrical connector comprising: an insulative housing having a base portion and a tongue portion extending forwardly from the base portion; a plurality of contact terminals disposed in the insulative housing, each contact terminal including a flat contact portion for connecting with a mating connector, a tail extending out of a back wall of the base portion for soldering with a printed circuit board, and a connecting portion connecting the flat contact portion and the tail; a metallic shell comprising a top wall, a bottom wall, and two side walls connecting with the top wall and the bottom wall for cooperatively defining a receiving room in which the mating connector is inserted; and a metal plate retained in the tongue portion of the insulating housing, the metal plate comprising at least one positioning end portion, the at least one positioning end portion extending out of the insulative housing for soldering with the printed circuit board, wherein the at least one positioning end portion is substantially coplanar with the tails of the contact terminals, wherein the metal plate comprises a plan main portion covering the tongue portion, and the plan main portion has a pair of side parts extending from two sides thereof and a front part extending from a front end thereof, the pair of side parts and the front part respectively covering the two side surfaces and the front surface of the tongue portion of the insulative housing, wherein the plan main portion defines a gap between each corner formed by each side part and said front part.

2. The electrical connector as claimed in claim 1, wherein the plan main portion comprises a rib extending downwardly from an upper middle surface thereof perpendicular to the side parts.

3. The electrical connector as claimed in claim 2, wherein the tongue portion comprises a plurality of location holes, the metal plate has corresponding through holes, and the location holes extends beyond the plan main portion through the corresponding through holes.

4. The electrical connector as claimed in claim 3, wherein the rib is located between the through holes.

5. The electrical connector as claimed in claim 3, wherein the rib has a length smaller than that of the though hole.

6. The electrical connector as claimed in claim 1, wherein the contact portion is wider than said tail, and a space between every two adjacent contact portions is narrower than that between every two adjacent tails.

7. The electrical connector as claimed in claim 6, wherein the at least one positioning end portion is wider than the contact portion.

8. An electrical connector comprising: an insulative housing defining a body portion and a mating tongue extending forwardly from the body portion, said mating tongue defining opposite first and second faces; a plurality of contacts disposed on the housing, each of said contacts defining a contacting section exposed upon the first face, and a tail section exposed rearwardly outside of the housing; a metallic plate integrally formed with the housing with a planar cover shielding the first face, and at least one solder pad exposed outside of the housing around the tail sections of the contacts; and a first metallic shell assembled to the housing to define a mating port in which said mating tongue extends forwardly, wherein said metallic plate is associated with the housing via an insert molding process, further including a second metallic shell assembled upon the first metallic shell, wherein said second metallic shell defines a U-shaped configuration so as to be assembled to the first metallic shell with an opening around the solder pad, wherein said second metallic shell is configured to be assembled to the first metallic shell in a vertical direction.

9. The electrical connector as claimed in claim 8, wherein said metallic plate defines two opposite solder pads by two sides of the tail sections of the contacts in a transverse direction.

* * * * *